United States Patent [19]

McMahon et al.

[11] Patent Number: 4,487,153

[45] Date of Patent: Dec. 11, 1984

[54] CAGE FOR UNDERSEA TETHERED VEHICLES

[75] Inventors: Terrence S. McMahon, Sterling, Va.; James P. Keller, Mitchellville, Md.

[73] Assignee: Eastport International, Inc., Lanham, Md.

[21] Appl. No.: 429,237

[22] Filed: Sep. 30, 1982

Related U.S. Application Data

[63] Continuation-in-part of Ser. No. 342,190, Jan. 25, 1982, abandoned.

[51] Int. Cl.[3] ..... B63G 8/00

[52] U.S. Cl. ..... 114/312; 242/82; 242/128

[58] Field of Search ..... 114/312, 221 R; 226/187, 188, 189; 242/81, 82, 83, 128; 254/287, 382; 405/185, 190; 441/24

[56] References Cited

U.S. PATENT DOCUMENTS

| | | | |
|---|---|---|---|
| 381,199 | 4/1888 | Young | 242/81 |
| 561,759 | 6/1896 | Briggs | 242/83 |
| 945,141 | 1/1910 | Salles | 441/24 |
| 3,202,372 | 8/1965 | Meline et al. | 242/82 |
| 3,270,981 | 9/1966 | Perren et al. | 242/128 |
| 3,490,713 | 1/1970 | Nystrom | 242/82 |
| 3,715,068 | 2/1973 | Clarke et al. | 226/188 |
| 3,750,970 | 8/1973 | Tremoulet, Jr. | 254/382 |
| 3,880,103 | 4/1975 | Talkington | 405/185 |
| 4,324,195 | 4/1982 | Cunningham et al. | 114/312 |

*Primary Examiner*—Trygve M. Blix
*Assistant Examiner*—Rodney Corl
*Attorney, Agent, or Firm*—Schwartz, Jeffery, Schwaab, Mack, Blumenthal & Koch

[57] ABSTRACT

A cage to retain an undersea vehicle therein and tether reel-in and play-out mechanism is provided. The cage includes a latch for retaining the vehicle in a "garage" portion. A tether drive assembly reels in and out the tether line through a bale which cooperates with a narrow, annular drum to retain the tether line in an annular, cylindrical coil having a width of a single strand of line. The bail, with or without cooperation from additional means, winds and unwinds the tether in the drum.

26 Claims, 19 Drawing Figures

CAGE FOR UNDERSEA TETHERED VEHICLES

This is a continuation-in-part of application Ser. No. 342,190, filed Jan. 25, 1982, now abandoned.

BACKGROUND OF THE INVENTION

1. Field of the Invention

The invention relates to a cage for undersea tethered vehicles, and more particularly to a cage having means for winding and storing the tether line.

Typically, the cage with the tethered vehicle therein is lowered into the water, and the vehicle is permitted to leave the cage with the tether line attached.

The tether must be paid out from, and reeled into the cage as the vehicle alternately departs and returns. The tether is typically several hundred feet long and slightly buoyant. The tether is thus vulnerable to entanglement on submerged objects which is a serious problem, inasmuch as tethered vehicles are normally used in proximity to underwater structures and often encounter strong underwater currents and restricted visibility. To minimize the likelihood of entanglement, it is desirable to be able to accurately control the length of tether that is paid out, and to keep this length free of twists.

2. Prior Art

Conventional rotating drum winches will reel cable in and out without imparting a twist do it. However, a rotating drum winch will not reel out satisfactorily unless an external tension is applied to the cable. Another disadvantage is that it is difficult and unreliable to wind cable smoothly onto a rotating drum in the confined space available in a vehicle cage. Still another disadvantage is that a system of terminals and slip rings must be used to transmit electrical signals from the tether on the rotating drum to the stationary transmission cable that leads back to the control station at the surface of the water. For these reasons prior art devices typically store the tether in a stationary drum. However, these devices produce a twist in the tether each time a loop is reeled into the drum. If the twist is absorbed by the length of tether in the drum, it will tend to cause adjacent loops to entangle. If the twist is absorbed by the length of tether outside the drum it will tend to cause the tether to become entangled with other objects in the water, including the cage and vehicle. It will also tend to damage the tether when the twisted length of tether is subsequently drawn into the drum, particularly when several twists are crowded close to one another as the vehicle approaches the cage.

One prior art device includes a cage which, in effect, rests on top of the underwater vehicle and stores only the tether. The tether includes a plurality of beads along the outside of the tether line. The beads operate in conjunction with the cog or toothed wheel on the cage to reel in and play out the tether. The cage only stores the tether, and the storing occurs in a generally loose manner in the cage with no specific orientation of the tether, except generally in a circular manner. The disadvantages of this system are the generally loose storing of the tether line in the cage, a complex tether line, and the extra bulk involved.

Another system involves a vehicle on a tether and a generally cylindrical cage which receives the vehicle therein. The cage is lowered by means of a winch from the deck of a ship. The cage and tether reeling and unreeling mechanism include a bale which rotates within the cage to reel and unreel the tether. It is believed that the tether line is positioned generally loosely in a circular manner in the cage, and the blade exerts a tension on the tether for the purpose of preventing the tether from snarling in the storage area of the cage. One disadvantage of this device is in the generally irregular positioning of the tether line in the cage.

In the prior art, when the tether is wound in a circular manner, for example in a cage, with or without the use of a bale, there is a tendency for the cable to twist and for some of the twists to accumulate in the length of tether between the cage and the vehicle when the tether is paid out of the cage, unless some other device is used or action taken. This causes a problem in reeling in the tether because all of the twists will be concentrated in the last 50 feet or so of the line adjacent the vehicle. Thus, in order to reel the entire tether line into the cage, without damaging it, the vehicle must maneuver around to remove the twist out of the tether, which is time-consuming and difficult to do with certainty.

OBJECTS AND SUMMARY OF THE INVENTION

One subject of the instant invention is to constrain the tether circumferentially and cylindrically in the cage in a single wrap, or layer, wherein the tether is stored in an annular space, the width of the space being only slightly wider than the diameter of the tether line. Thus, with each loop around the drum in the annular space there will be one twist of the tether, and that one twist will be confined to one loop which cannot work its way down the tether. When a loop is paid out of the drum, the twist will inherently be removed from the tether. Also, by providing the layered, annular storage, one loop of the tether cannot pass over another loop causing the tether line to knot.

Another proposed object is the utilization of a hollow bale and the thrust of the tether passing through the bale for causing the rotation of the bale and the guiding of the tether into the drum. The bale supports the tether throughout the space between the fixed position of the tether drive means and the stationary drum, while allowing and assisting it to wrap smoothly into the drum. With this uninterrupted support, uniform distribution and containment of twists within the drum is achieved.

The vehicle, which is shaped in a generally cylindrical manner, includes a ring at the upper end thereof which is retained by a plurality of spring loaded hooks located in the cage. By solenoid operation, the vehicle can be released from the hooks. The vehicle and cage are so configured that the vehicle is centered within the cage by the operation of reeling in the tether, so that the ring can be grabbed by the hooks when the tether reeling is completed.

A cage to retain an undersea vehicle therein and tether reel-in and play-out mechanism is provided. The cage includes latch means for retaining the vehicle in a "garage" portion. A tether drive assembly reels in and out the tether line through a bale which cooperates with a narrow, annular drum to retain the tether line in an annular, cylindrical coil having a width of a single strand of line. The bale, with or without cooperation from additional means, confines and supports the length of tether between the tether drive assembly and the drum, and guides the winding and unwinding of the tether. By counting the rotations of the bale, an exact measurement of the length of tether paid out of the drum is obtained.

BRIEF DESCRIPTION OF THE DRAWINGS

The above and other advantages will become apparent from the following description and the accompanying drawings, wherein.

DETAILED DESCRIPTION OF THE INVENTION

Figure 1:
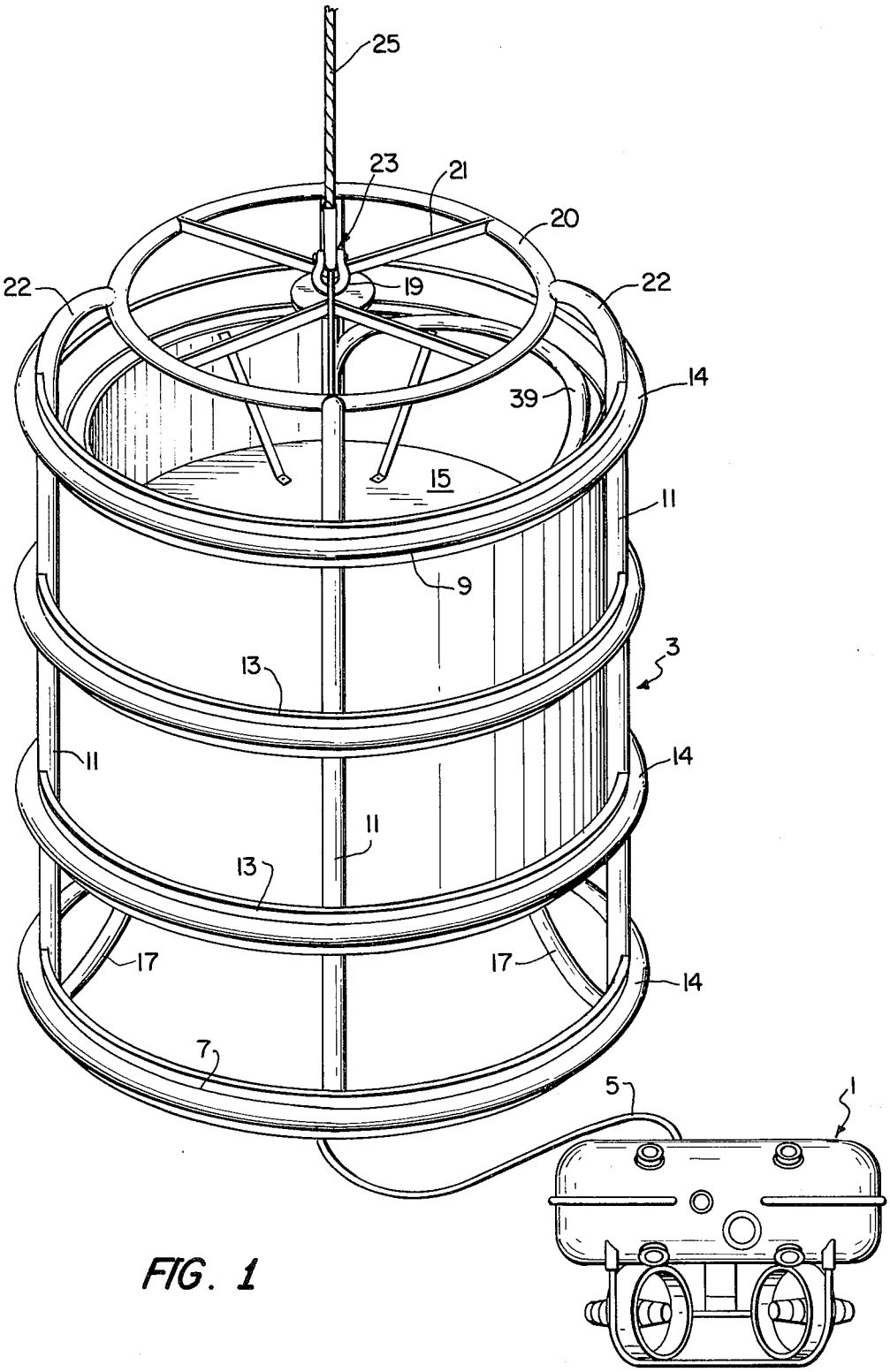
FIG. 1 is a perspective view of the cage and a tethered vehicle attached thereto.
Figure 2:
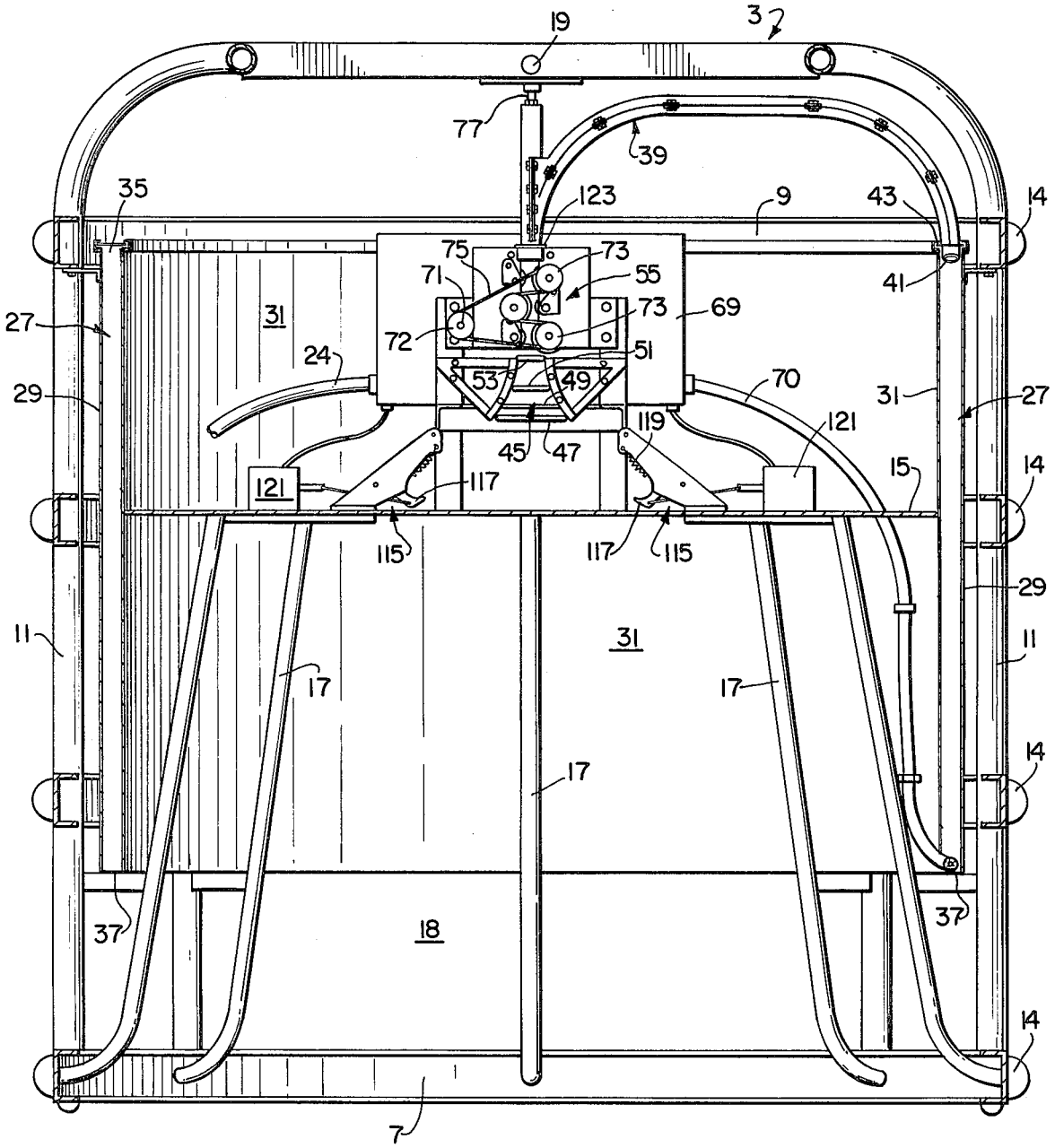
FIG. 2 is a side elevation view, partially in cross-section, of the cage of FIG. 1.
Figure 3:
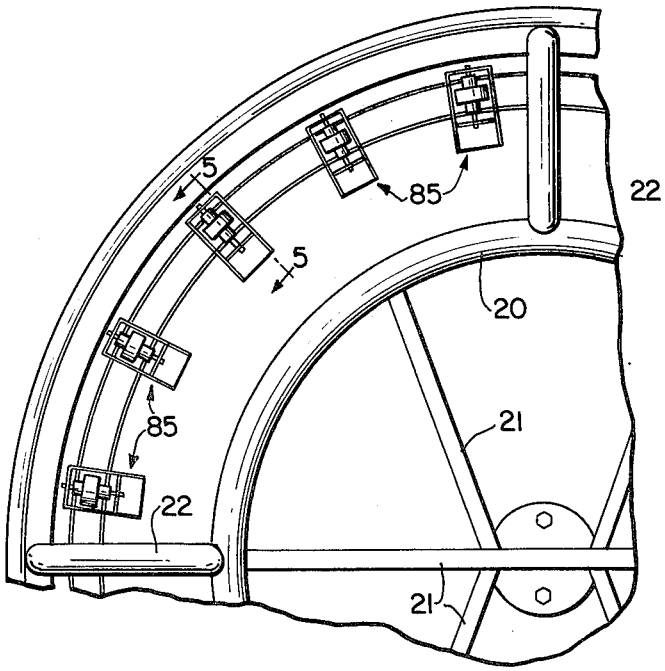
FIG. 3 is a fragmentary top plan view of the cage of FIG. 1.

Referring to FIGS. 1 and 2, an undersea vehicle 1 is connected to a cage 3 by means of a tether 5. The cage is formed by a lower supporting ring 7 and an upper mooring ring 9 by means of a plurality of generally vertical upright supports 11. There are positioned a number of intermediate rings 13, each support ring having a bumper 14 secured thereon. About midway between the upper and lower rings is located a platform 15. A plurality of centering guides 17 are connected between the lower ring 7 and the platform 15 to form a generally frustro-conical receiving garage 18 for the complementary shaped vehicle 1. Thus, in raising and lowering the vehicle and cage from the deck of a ship, the vehicle 1 will be entirely encased in the garage portion 18 formed by members 7, 15, 17. This will, of course, protect the vehicle.

The upper ring 9 includes a hole 19 located on one of a plurality of brackets 21 supported by a ring 20, the ring 20 being attached to ring 9 by extensions 22 of supports 11. The hole 19 cooperates with a shackle or cable termination 23 to which is attached a cable 25. The cable 25 forms not only the structural support for the cage but also includes all of the electrical wiring to operate the mechanisms discussed below and which will, of course, provide the electrical power and control to the vehicle 1, as well as the reeling and unreeling mechanism. A conventional device (not shown) provides an outlet of the wiring in the cable 25 to connect to the electrical components through line 24.

Surrounding the platform 15 and extending therebelow to near the bottom, and extending upwardly adjacent to ring 9, is a cylindrical annular drum 27 formed by an outer wall 29 and an inner wall 31. One of the walls may optionally be formed of mesh material having openings (not shown) so that the annular storage area is free-flooding; thus, no pressure can build up external to the storage area. At the upper end of the drum 27 there is located an opening 35; whereas, the bottom of the drum is closed by a lower wall 37 upon which the tether rests. A bale seen generally at 39 has an extremity 41 directed downwardly and angled backwardly at about 60° into the drum. The end of the bale 41 is connected to a lid or bracket 43 at the top of the drum 29, thus causing the lid or top of the drum to rotate relative to the remainder of the drum whereby the tether is laid within the drum, one strand on top of another.

The tether enters through a tether guide 45 which is in the form of rings, a wider ring 47 at the bottom and narrower rings 49, 51, 53 at the top which center the tether in a drive assembly 55.

Figure 4:
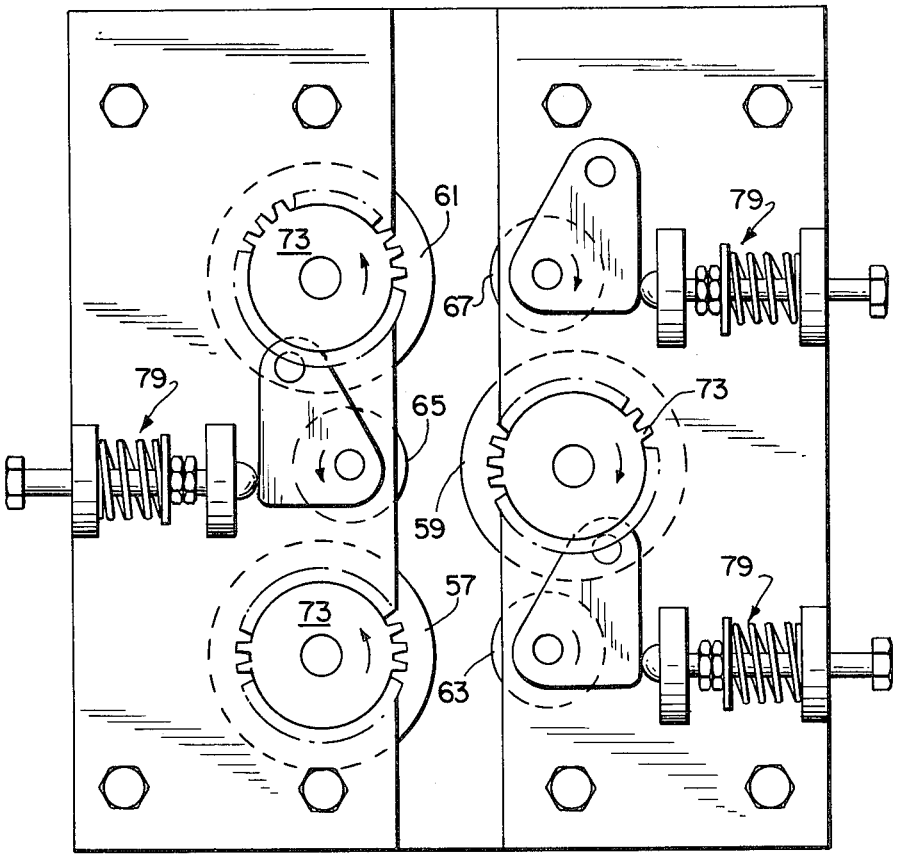
FIG. 4 is a detailed view of the drive rollers of FIG. 2.

The tether than enters a plurality of drive rollers cooperating with idler rollers. Referring to FIG. 4, the drive rollers, three in number, are seen at 57, 59 and 61 and cooperate with a plurality of idler rollers 63, 65 and 67, respectively. The tether drive rollers 57–61 are driven by a motor (not shown) in an oil filled box 69 (seen in FIG. 2) which is designed to protect against ambient pressure. Exiting from the box 69 is tether 5 to the bottom of drum 27 connecting power and other electrical feeds to vehicle 1, as well as a shaft 71 attached to the motor. Through a plurality of gears 72, 73 and a chain drive 75, the rollers 57–61 are driven to force the tether up through bale 39 and down into drum 27. The bale includes a pair of conventional bearings, one being a jewel-type bearing 77 at the top and the other being a plastic bearing (not shown) at the bottom.

Each time bale 39 makes a complete revolution, a given amount of tether is paid out—in the instant case the amount is thirteen feet. Thus, by means of a counter (not shown) the number of revolutions of the bale is counted, and the number of feet is read out on an instrument aboard ship.

The drive rollers 57–61, cooperating with the idler rollers 63–67, engage the tether by friction force, therebetween. There are a plurality of tension spring mechanisms 79 to adjust the frictional force on the tether.

The bale 39 has a low friction liner in the form of a "TEFLON" tube to permit the tether to pass easily therethrough. As mentioned above, the angular, backward direction of the end of the bale is to assist in the movement around the drum and the proper laying of the tether in drum 27. The tether guide 45 can be split open to permit the tether to be easily inserted therein.

Figure 5:
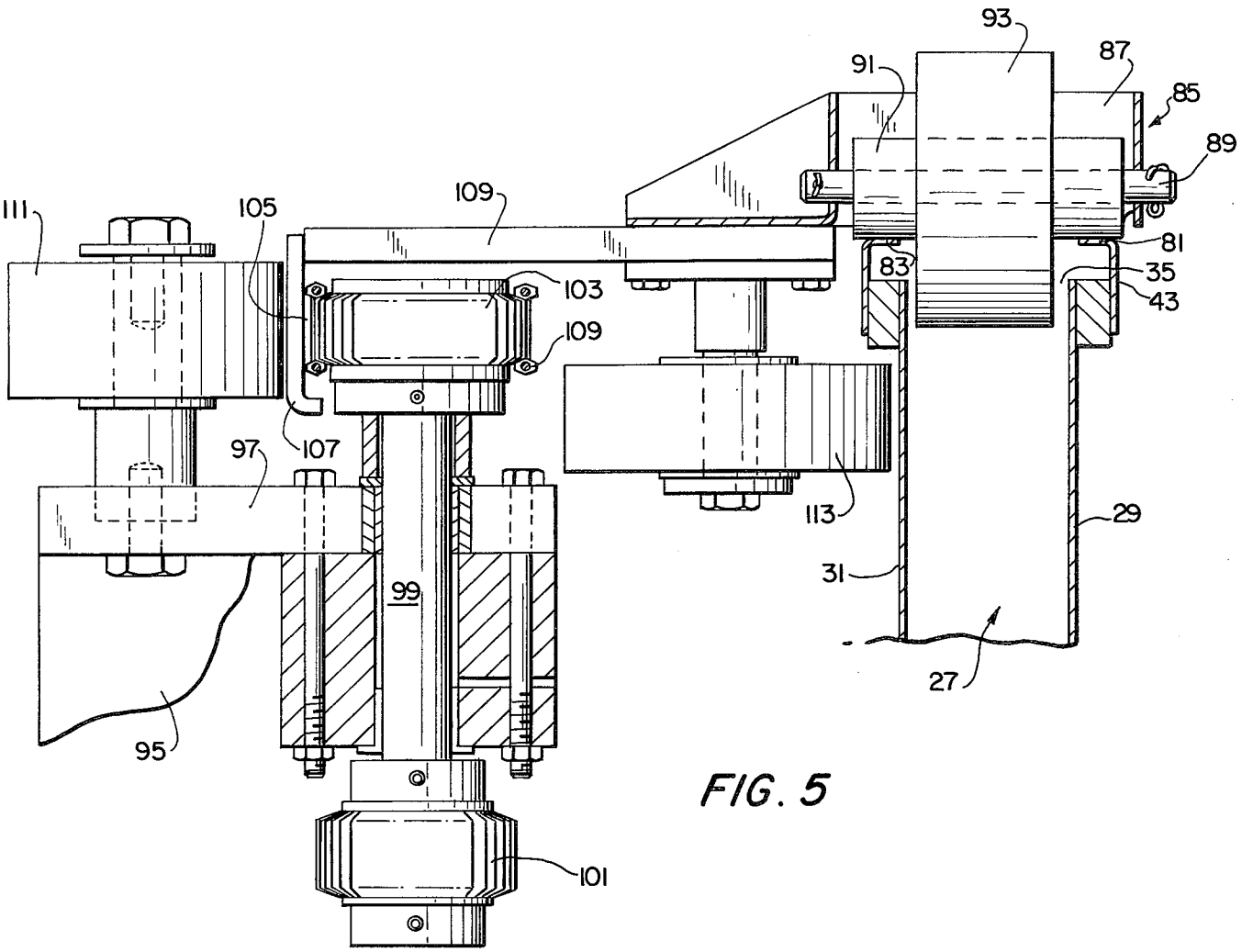
FIG. 5 is a cross-sectional view taken along lines 5—5 in FIG. 3.

Referring to FIG. 5, the top of each drum wall 29 and 31 includes a pair of top lips 81 and 83, respectively, cooperating with a plurality of lip roller assemblies 85. Each lip roller assembly 85 includes a bracket 87 having a lip roller axle 89 rotatably mounted therein. A lip roller 91 rotates an axle 89 and lips 81 and 83. A tether restraining roller 93 rotates on lip roller 91 to roll over the tether line accumulating in drum 27 since the tether line will float to the top.

Positioned on platform 15 is a stand-off bracket 95 which supports at a top 97 an axle 99. At one end of axle 99 is a drive sprocket 101 connected by conventional means (not shown) to the motor in box 69, for example via shaft 71. At the other end of axle 99 is located another sprocket 103. Sprocket 103 can cooperate with a plurality of teeth 105 on the inner surface of a ring 107 depending from a horizontal annular plate 109 which also supports the roller lip assemblies 85, or, preferably, a chain 109 which in turn is supported on teeth 105 on the inner surface of depending support ring 107. There are obviously numerous other ways of driving support 109 and related assemblies. If a rack and pinion drive mechanism between sprocket drive 103 and teeth 105 on the inner surface of 107 is utilized, then an idler roller 111 supported on 95 would be used most advantageously.

A plurality of rollers 113 located around the periphery and rotatably depending from support 109 are used to center and otherwise locate the lip roller assemblies 85 relative to drum 27.

Referring to FIG. 2, a plurality (preferably three) of vehicle latches 115 are seen. The latches have hooks 117 which are spring set with a plurality of springs 119 and released by individual solenoids 121 in a conventional manner. The spring force and hook suspension points are designed to permit latch actuation by about a six pound buoyant upward force of the vehicle 1 in garage 18.

Above the drive assembly 55, rotating with the bale 39, is a cable counter (not shown). The counter comprises a flat plate mounted at 123. Positioned on the plate are a plurality of permanent magnets which cooperate with a magnetically activated switch to record the rotational movement, and hence the play-out or reel-in of the tether line in the conventional manner.

Figure 6:
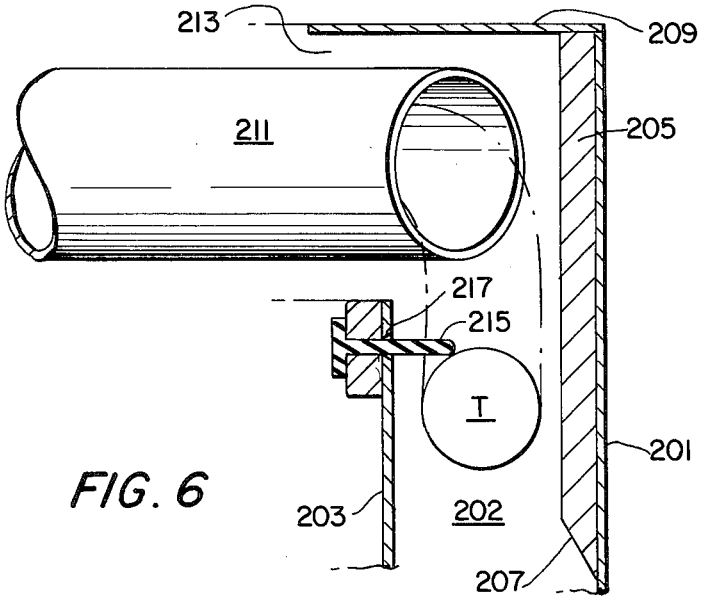
FIG. 6 is a sectional view of the drum and bale of the new embodiment of the invention.

Referring now to the embodiment of FIGS. 6–11, it will be seen that there is a change from the previous modification relative to how the bale enters the drum. Specifically, as seen in FIG. 6, the drum has an outer wall 201 about one-sixteenth of an inch in thickness, as well as having an inner wall 203 of about the same size. An annular space 202 is formed between the walls 201 and 203. Attached to the inner surface of outer wall 201 is a metal step plate 205, preferably about one-quarter inch in thickness. Plate 205 extends essentially from the top of the drum to about four inches down from the top on the outer wall. Plate 205 has a tapered or beveled portion 207 forming a beveled step with relation to the outer wall 201. At the top of the drum is a lid 209.

A bale seen at 211 enters into the drum through a space 213 between lid 209 and inner wall 203. This is in contradistinction to the design discussed relative to FIGS. 1–5 above.

Positioned about every 30 degrees around the inner wall of the drum is a relatively small, flexible insert 215. The insert 215 is squeezed through an opening 217 in the inner wall 203. The flexible insert is essentially formed from O-ring material and is seen in plan view in FIG. 7. When the tether T enters through opening 213 via bale 211, it comes in contact with the step plate 205 adjacent the opening of the bale and above the inserts 215.

Figure 7:
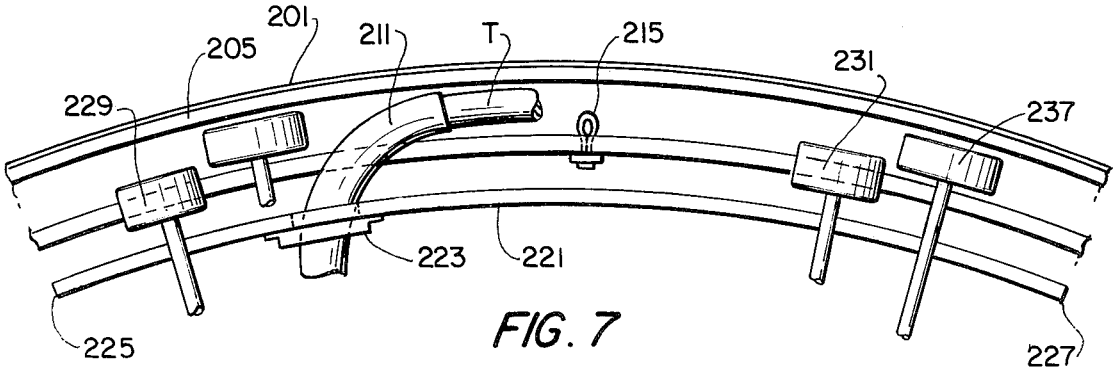
FIG. 7 is a partial top plan view of the drum and bale of FIG. 6.

The bale is driven around the periphery of the drum as seen in FIG. 7 by means of the tether T coming out of the bale 211 and abutting against the plate 205. This, in effect, pushes the bale 211 around the circumference of the drum in a manner similar to that discussed with regard to FIGS. 1–5. The diameter of the loop of tether T being inserted into the space 202 in the drum is determined by the inner diameter of the step plate 205. As the bale rotates around the drum, depositing a layer of tether on top of the previous layer or loop, the newly deposited loop will push the loop beneath it down through the flexible insert 215. The abvious reason for the flexible insert 215 (as well as other modifications discussed below) is to prevent the tether T from floating up and out of the annular space 202 when the vehicle is submerged in the water. Also, once the loop of the tether descends below the beveled portion 207 of step plate 205, it no longer provides any resistance to the additional loops of tether being deposited in the drum.

As seen in FIG. 7, the bale 211 is clamped to a roller bracket 221 by means of a clamp 223. The roller bracket extends from point 225 to point 227. Secured to the roller bracket 221 are a plurality of rollers. These are seen in FIGS. 7–11. A first set of rollers 229 and 231 seen in FIGS. 7, 8 and 9 form stabilizing rollers. Stabilizing rollers 229 and 231 preferably include a flanged area 233 to assist in riding on top of wall 203.

Figure 8:
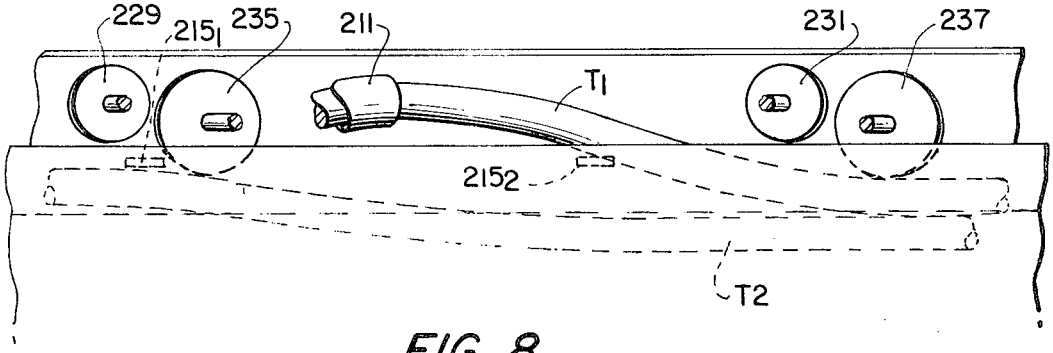
FIG. 8 is a fragmentary side elevation view of the drum and bale of FIGS. 6 & 7.

Also attached to the roller bracket 221 are a second pair of rollers in the form of tamping rollers 235 and 237. These are seen in FIGS. 7, 8, 10 and 11. The purpose of the tamping rollers is to assist in inserting the tether into the drum. An illustration is best seen in FIG. 8, wherein a portion of the tether T1 is emerging from the bale 211; whereas, a portion of the tether T2 (which is the loop below T1) is seen being maintained below flexible insert $215_1$ and T1 is just being pushed through insert $215_2$.

Figure 9:
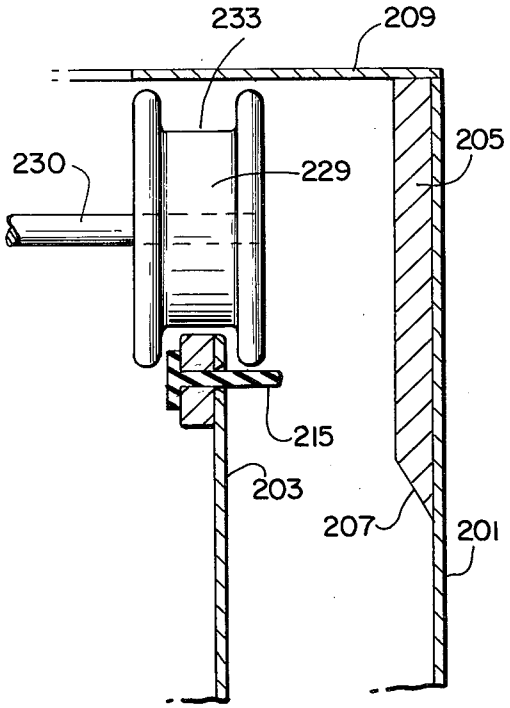
FIG. 9 is an elevation view, partially in cross-section, showing a stabilizing roller riding on the drum.
Figure 10:
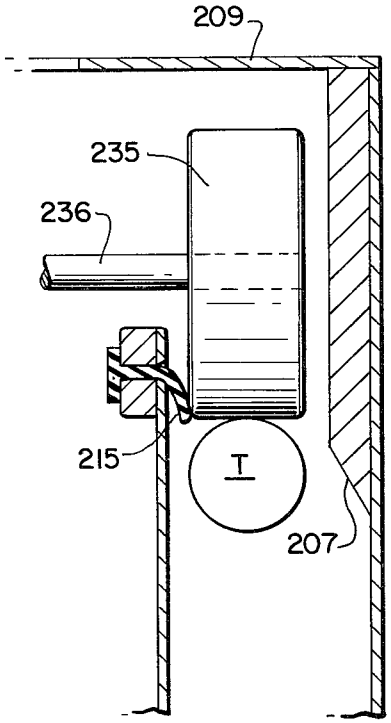
FIGS. 10 and 11 are elevation views, partially in cross-section showing a tamping roller in progressive relation to the tether.
Figure 11:
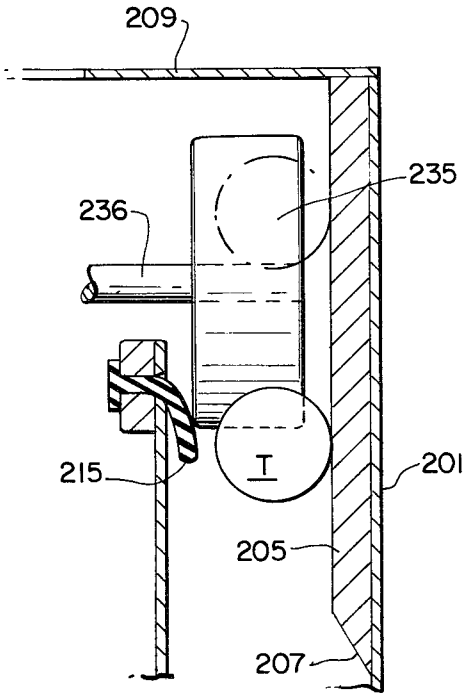

It will be noted that the rollers 229 rotate on an axis 230 seen in FIG. 9, which axis is secured in the conventional manner to the rotating bracket 221. Roller 235 rotates on an axis 236, also secured to the roller bracket 221 in a conventional manner.

To recapitulate the aspects above, the step plate 205 provides a firm resistance to the "push" of the tether, to assist in rotating the bale. Plate 205 also helps keep the tether therebelow loose enabling it to freely float. The inserts are provided to maintain the tether in the drum and preventing it from popping out thereof. Finally, the tamping rollers 235 and 237 are used to assist in moving the tether below the inserts.

There are also provided various modifications to the rollers, and these will be discussed below.

Figure 12:
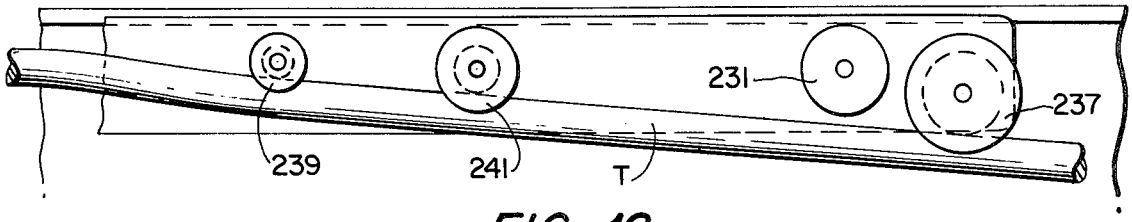
FIG. 12 is a side elevation view illustrating a modified form of the rollers seen in FIG. 8.
Figure 13:
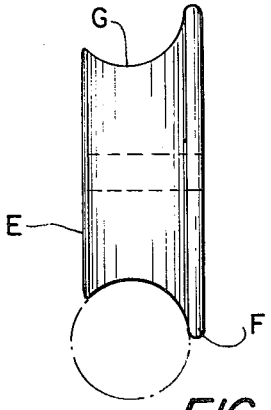
FIGS. 13–15 are side elevation views of the rollers seen in FIG. 12.
Figure 14:
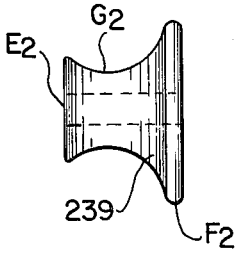
Figure 15:
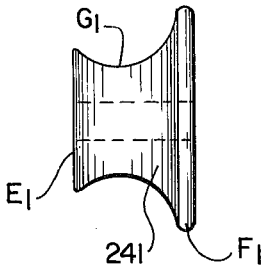

As seen in FIG. 12, rollers 231 and 237 can be placed slightly farther away from the bale 211. Inserted between the bale 211 and the rollers 231, 237 are a plurality of additional tamping rollers 239 and 241. The crossectional or side elevation views of rollers 237, 239 and 241 are seen in FIGS. 13, 14 and 15, respectively. Both the location and the configuration of the tamping rollers is important in order to prevent the tether T from being bent downwardly in too sharp an angle. The ideal angle of the tether T being pushed down is seen in FIG. 12. An ideal configuration would also be to allow one loop of the tether to remain on the step plate 205 after it has come in contact with the tamping rollers 237–241. In this way, the tether will be captured below the inserts 215, yet will remain in contact with plate 205 to provide the force reaction for the bale.

Referring to FIGS. 13–15, each has a flange F seen as F, F2 and F1 respectively. Each of these flanges abuts adjacent the inside wall 203. The tamping rollers also each have a groove G, G2 and G1, respectively, which have the same radius as the radius or outside configuration of the tether T. However, the distance from the inside of the flange F to an opposite edge E (E, E2 and E1, respectively, in FIGS. 13–15) of the tamping roller is less than the diameter of the tether so that the tamping roller will always assist in exerting a force on the tether against the plate 205. Thus, the contour will assist in pushing the tether against the step plate 205 as the tether is pushed down into the drum. (The flange extends downwardly sufficiently to keep the tether from pulling away from the stepped plate 205.)

The rollers 239 and 241 are of a diameter such that they assist in the gradual incline of the tether from the bale 211 into the drum space 202, as opposed to a sharp bend adjacent roller 237 which can occur without the assistance of rollers 239 and 241.

Figure 16:
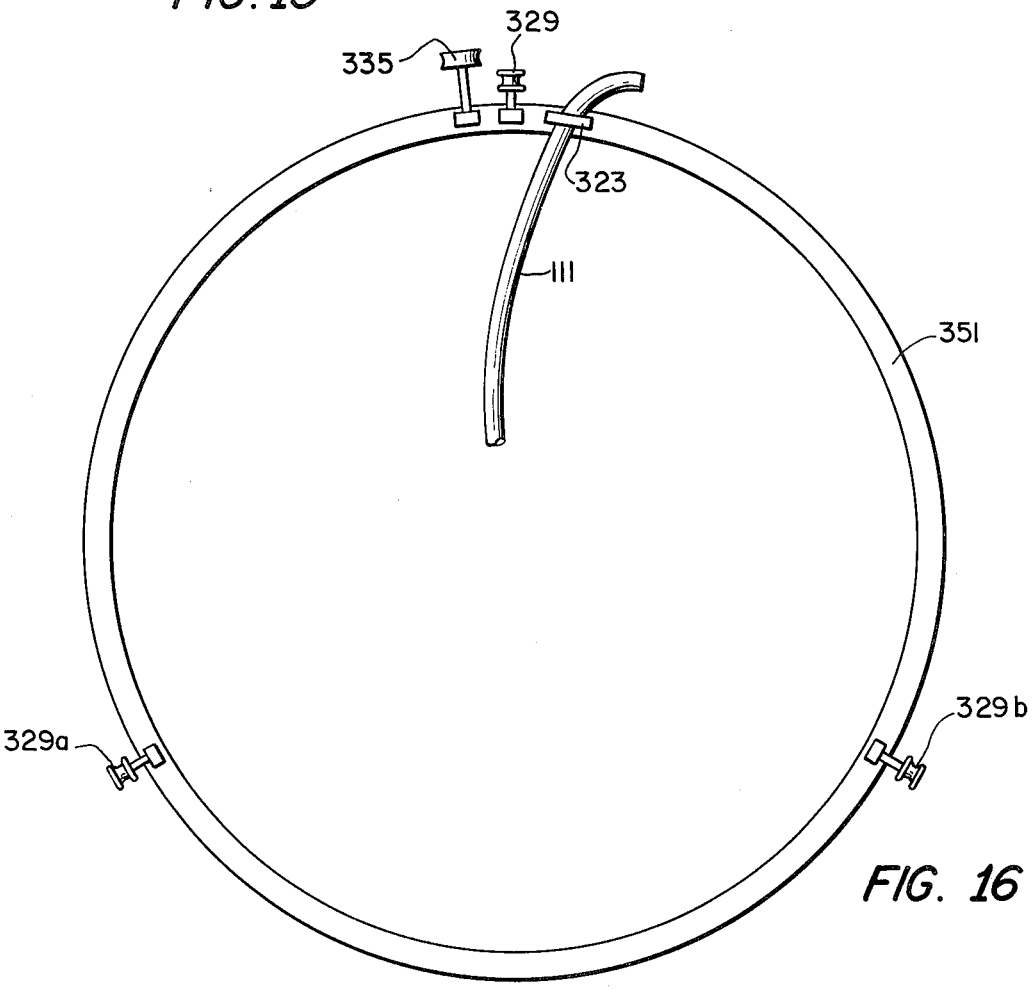
FIG. 16 is a further modification of a bale drive mechanism.
Figure 17:
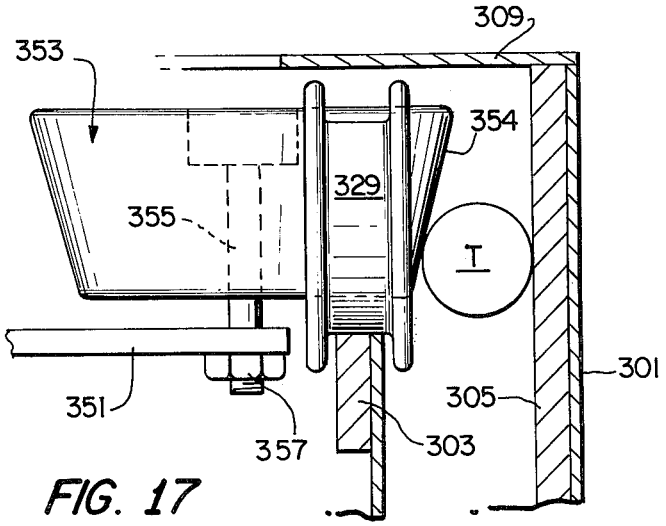
FIG. 17 is an elevation view, partially in cross-section, showing a detail of the means for retaining the tether in the drum.

Reference is now made to the modification illustrated in FIGS. 16 and 17. A bale drive ring 351 moves with the bale 111. As will be seen, the bale drive ring 351 and associated parts assist in maintaining the tether within the drum. A single tamping roller 335 is positioned behind the bale 111. A plurality of stabilizing rollers 329, 329*a* and 329*b* can be positioned on the ring, one behind the bale 111 and the additional ones 120° apart at 329*a* and 329*b*. It will be appreciated that like parts in FIGS. 16 and 17 relative to FIGS. 6–11 have a "three hundred" prefix, as opposed to the "two hundred" prefix in FIGS. 6–11. Located on ring 351 are a plurality of rollers 353 which are located every 30°–60° around the circumference of the drive ring 351. The rollers 353 which have a tapered outer edge 354 are rotatably mounted in a conventional manner on axis 355 in the form of a nut and bolt arrangement 357. The rollers 353 replace the flexible inserts 315 discussed above and alleviate the need for the additional tamping rollers 239, 241. The tapered edge 354 cooperates with the step plate 305 to assist in holding the tether within the drum.

Figure 19:
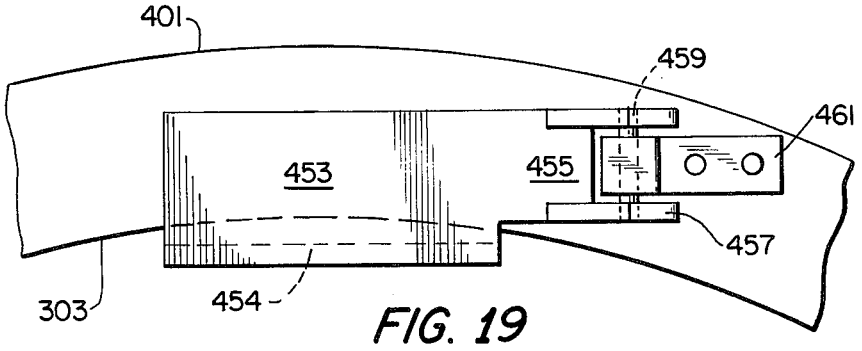
FIG. 19 is a top plan view of FIG. 18.
Figure 18:
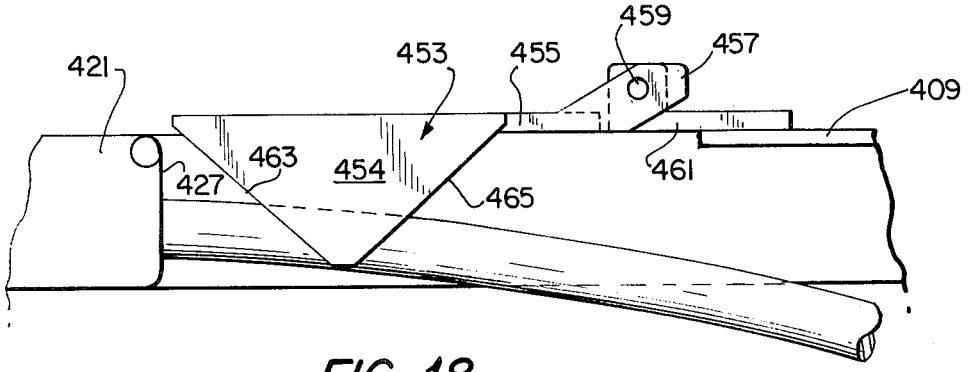
FIG. 18 is a side elevation view of yet another modification showing means for retaining the tether in the drum.

Referring now to FIGS. 18 and 19, a yet further method is used to maintain the tether within the drum. In place of the roller 353 discussed immediately above in relation to FIG. 17, a rigid, pivoting member 453 can be mounted on lid 409 by means of an arm 455 and a pair of wings 457 mounted on an axis 459 positioned in a bracket 461. The member 453 has a first tapered portion 463 designed to cooperate with end portion 427 of the roller bracket 421 (see FIG. 7 above), whereby as the roller bracket 421 moves toward the pivoting member 453, member 453 will pivot up and out of the way. Member 453 also has a tapered portion 465 on the opposite side of 463 to cooperate with an end (comparable to 225 bracket 221 in FIG. 7) when the mechanism is rotated in the opposite direction. Obviously, depending portion 454 of member 453 is used to maintain the tether within the drum.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A cage for tethered vehicles comprising:

drive means for reeling a tether in and out of the cage;

means for constraining the tether in the cage in a substantially circumferential, cylindrical manner in a substantially single wrap, said constraining means being generally of a width slightly wider than the diameter of the tether; and a rotating bale means between said drive means and said constraining means for receiving said tether and depositing the tether in the constraining means, said bale means being freely rotatable when said tether is no received therein such that said tether passing in and out through said bale means causes said bale means to rotate.

2. A cage as defined in claim 1 wherein said constraining means is an annular drum positioned around the cage.

3. A cage as defined in claim 2 wherein said drum has a top and a bottom, said bale has one end adjacent said drive means and another end adjacent to the top of said drum, and the end of said bale adjacent the top of said drum is angled in a direction from which said bale is rotated.

4. A cage as defined in claim 3 wherein said angle is about 60°.

5. A cage as defined in claim 1 wherein the cage has a large area to substantially completely receive the vehicle therein.

6. A cage as defined in claim 5, including latch means for retaining and releasing the vehicle in the cage.

7. A cage as defined in claim 3 including means at the top of said drum for preventing the tether from floating out therefrom, said preventing means rotating with said bale means.

8. A cage as defined in claim 7 including motor means for driving said drive means, said motor means also rotating said preventing means.

9. A cage as defined in claim 8 wherein said preventing means includes a plurality of rollers.

10. A cage as defined in claim 1 wherein said drive means includes a plurality of drive rollers cooperating with a plurality of idler rollers, said drive rollers being connected to a drive motor.

11. A cage as defined in claim 2 wherein said drum has an inner wall and an outer wall and an opening at the top thereof, said bale entering said opening.

12. A cage as defined in claim 11 wherein said opening is adjacent the top of the inner wall.

13. A cage as defined in claim 12 including a plate on the inside of said outer wall opposite said opening.

14. A cage as defined in claim 13 wherein said plate extends below said opening and has a beveled lower edge.

15. A cage as defined in claim 12 including means extending into said drum for maintaining the tether in said drum.

16. A cage as defined in claim 15 wherein said retaining means is a flexible insert mounted on said inner wall and extending into said drum toward said outer wall.

17. A cage as defined in claim 16 including a plate mounted on said outer wall and wherein said insert is opposite said plate.

18. A cage as defined in claim 11 including a bracket rotatably mounted on said drum, said bale mounted on said bracket.

19. A cage as defined in claim 18 including means for retaining the tether in said drum, said retaining means being in the form of a pivoting member mounted on said bracket and extending into said drum.

20. A cage as defined in claim 18 including a plurality of rollers mounted on said bracket and extending through said opening.

21. A cage as defined in claim 20 wherein at least one of said rollers rolls on said inner wall.

22. A cage as defined in claim 20 wherein at least one of said rollers extends through said opening into said drum and contacts the tether.

23. A cage as defined in claim 22 wherein said rollers have a flange abutting adjacent said inner wall and an edge opposite said flange, the distance between said edge and said flange being less than the diameter of the tether, and a groove in said roller between said edge and said flange, said groove having a radius about the same as the tether.

24. A cage as defined in claim 11 including a drive ring rotating on said drum, said bale being attached to said drive ring and at least one tapered roller mounted on said drive ring and extending into said drum.

25. A cage as defined in claim 1 wherein said vehicle comprises an undersea vehicle.

26. A cage as defined in claim 12 including an offset formed on the top of said outer wall to prevent said tether from floating up out of said opening.

* * * * *